United States Patent [19]

Brunner

[11] Patent Number: 4,947,511

[45] Date of Patent: Aug. 14, 1990

[54] DEVICE FOR PNEUMATIC DUST REMOVAL OF YARN SUPPLY CARRIERS OF TEXTILE MACHINES

[75] Inventor: Heinz Brunner, Albstadt-Ebingen, Fed. Rep. of Germany

[73] Assignee: Sipra Patententwicklungs-und Beteiligungsgesellschaft mbH, Tailfingen, Fed. Rep. of Germany

[21] Appl. No.: 165,833

[22] Filed: Mar. 9, 1988

[30] Foreign Application Priority Data

Mar. 13, 1987 [DE] Fed. Rep. of Germany ..... 3708185

[51] Int. Cl.[5] ..... B65H 49/14

[52] U.S. Cl. ..... 15/312.1; 15/301; 15/316 R; 15/319; 57/304

[58] Field of Search ..... 15/312 A, 312 R, 303, 15/319, 405, 316 R; 57/304, 305

[56] References Cited

U.S. PATENT DOCUMENTS

| | | | |
|---|---|---|---|
| 2,063,873 | 12/1936 | Hodge | 15/312 R |
| 2,549,601 | 4/1951 | Herren | 57/304 |
| 2,814,176 | 11/1957 | Bowie | 57/304 |
| 3,269,151 | 8/1966 | Abrams et al. | 15/312 R |
| 3,525,117 | 8/1970 | Gleaton | 15/312 R |
| 3,945,081 | 3/1976 | Cook et al. | 15/312 R |
| 4,697,298 | 10/1987 | Mulligan | 15/312 R |
| 4,784,349 | 11/1988 | Renwick et al. | 15/301 X |

*Primary Examiner*—Chris K. Moore

*Attorney, Agent, or Firm*—Michael J. Striker

[57] ABSTRACT

A dust removal device for yarn supply carriers and thread guides of textile machines comprises blowers movable past the yarn supply carriers and supported on a common supporting bar. The blowers and all driven by a single common drive motor which not only rotates the vanes of the blowers but also imparts to the same the movement past the yarn supply carriers.

16 Claims, 7 Drawing Sheets

DEVICE FOR PNEUMATIC DUST REMOVAL OF YARN SUPPLY CARRIERS OF TEXTILE MACHINES

BACKGROUND OF THE INVENTION

The present invention relates to a pneumatic device for removing dust from yarn supply carriers and thread guiding organs of textile machines, provided with a plurality of blowers.

It has been known in knitting and hosiery knitting machines and yarn spool carriers of textile machines in which the yarn is pulled off the spools to the yarn guiding elements that fuzz depositing on such structural components has been prevented by means of blowers or ventilators. Such an arrangement has been disclosed, for example in German document DE-GM 76 37 452. Blowers have nozzle devices, the advantage of which resides in that they can be driven by electric motors so that no compressors or any respective pressurized air distributing devices in the production are required, and, in addition, such blowers require less energy consumption than motor-driven nozzle devices. When a number of blowers are employed which are required in large machines, and particularly with large yarn spool carriers the utilization of a plurality of electric motors each assigned to the respective blower means becomes, however expensive. Each blower requires a current supply device; and the total number of individual electric motors require a relatively high current consumption with the resulting low efficiency of small electric motors as compared to larger motors.

SUMMARY OF THE INVENTION

It is an object of the present invention to provide an improved dust removal device for textile machines.

It is another object of the invention to provide a dust removal device with which energy consumption for the drive of the blowers would be substantially reduced.

These and other objects of the invention are attained by a device for pneumatically removing dust from yarn supply carriers and thread guiding organs of textile machines, comprising a plurality of blowers movable relative to the yarn supply carriers; means to drive said blowers; and supporting means to rigidly connect said blowers to each other, said drive means including a single common motor for driving all said blowers.

The drive means may further include means for coupling said blowers with said common motor, said coupling means including at least one endless element producing a form-locking or force-locking drive connection with said motor.

The drive means may include means for coupling said blowers with said common motor, said coupling means including at least one endless element producing a form-locking and force-locking drive connection with said motor.

The endless element may be a belt, a chain or a tape.

The common motor may be arranged to additionally effect a movement of said blowers past said yarn supply carriers and thread guiding organs in addition to imparting a rotational motion to the blowers whereby the blowers can perform such a movement either along the straight path or curved path.

With the device of this invention, individual drive motors for the blowers are no longer necessary, and the single motor provides a better efficiency and output. The vanes of the blowers can be supported directly, or in any suitable simple fashion together with the belt pulleys, on the supporting bar. Thus conductive lines for individual blowers are no longer necessary.

The device which is used for dusting off a circular creel spool carrier, which includes a rotation-symmetrical frame having an inner space, has said supporting bar with said blowers accommodated in said space, said supporting bar being vertical and being movable along a circular path concentrical with said frame, said drive means further including a single endless belt and belt pulleys connecting said common motor to said blowers to drive the latter, said blowers being radially aligned with said circular path and being spaced from each other, each belt pulley being assigned to a respective blower, and guide rollers positioned between said belt pulleys, said belt being guided over said pulleys and said guide rollers.

The common motor may be positioned above or below the single endless belt.

Alternatively, the drive means may include a plurality of individual endless belts each connecting at least two neighboring blowers to each other, one of said blowers being additionally driven-connected with said common motor.

In place of the belt or belts, a chain and chain wheels can be employed in the drive means of this invention.

The common motor may be either stationarily positioned or run along with the supporting bar.

The drive means may further include a shaft and a gearing connected thereto to couple said common motor with said supporting bar so as to effect the thereof along the circular path.

A speed of said common motor, a running time and running time-intervals may be controlled and adjusted to different places of application or different yarns.

The common motor may be coupled to a control device to obtain an intermittent motor operation.

The novel features which are as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
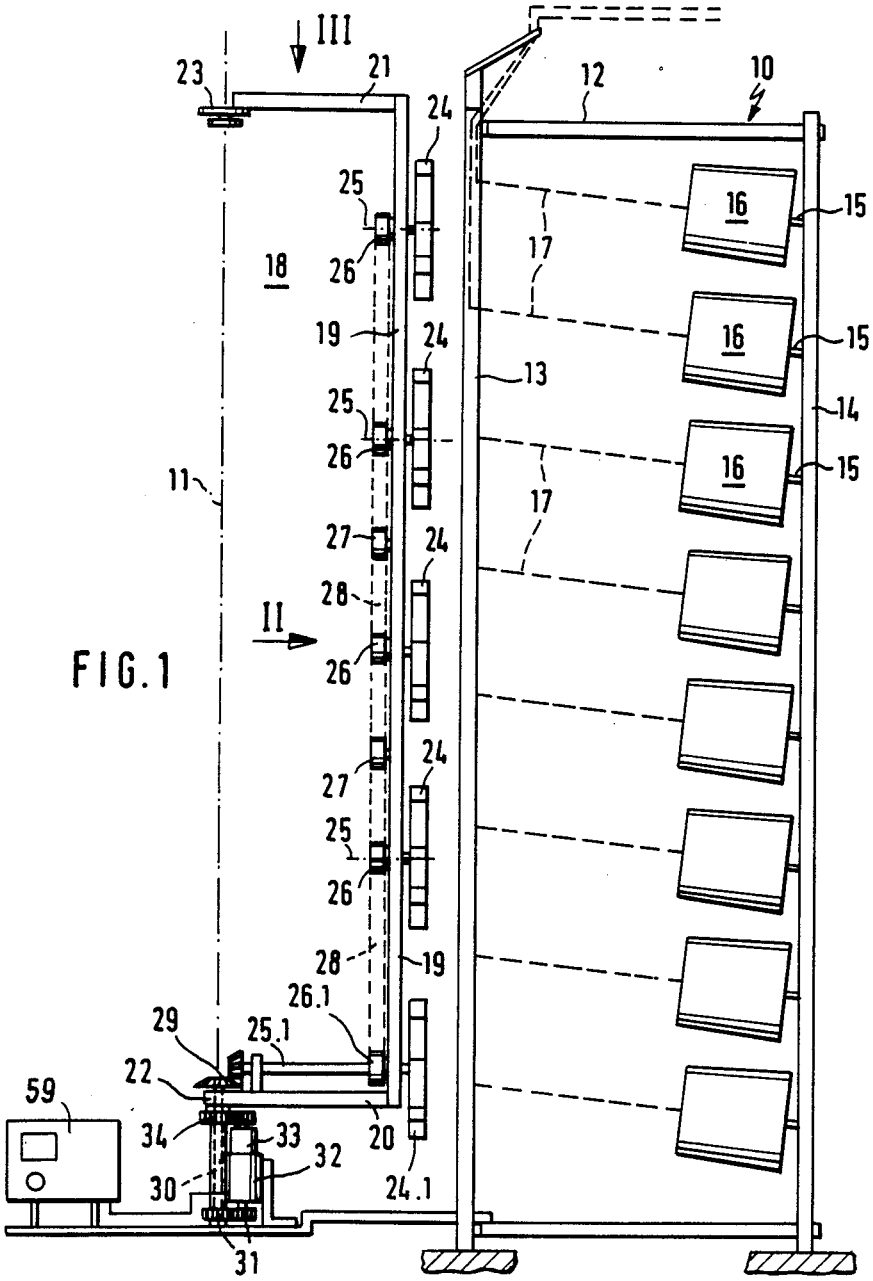
FIG. 1 is a schematic radial view of a circular creel-yarn spool carrier provided with a dust removal device of the invention.
Figure 2:
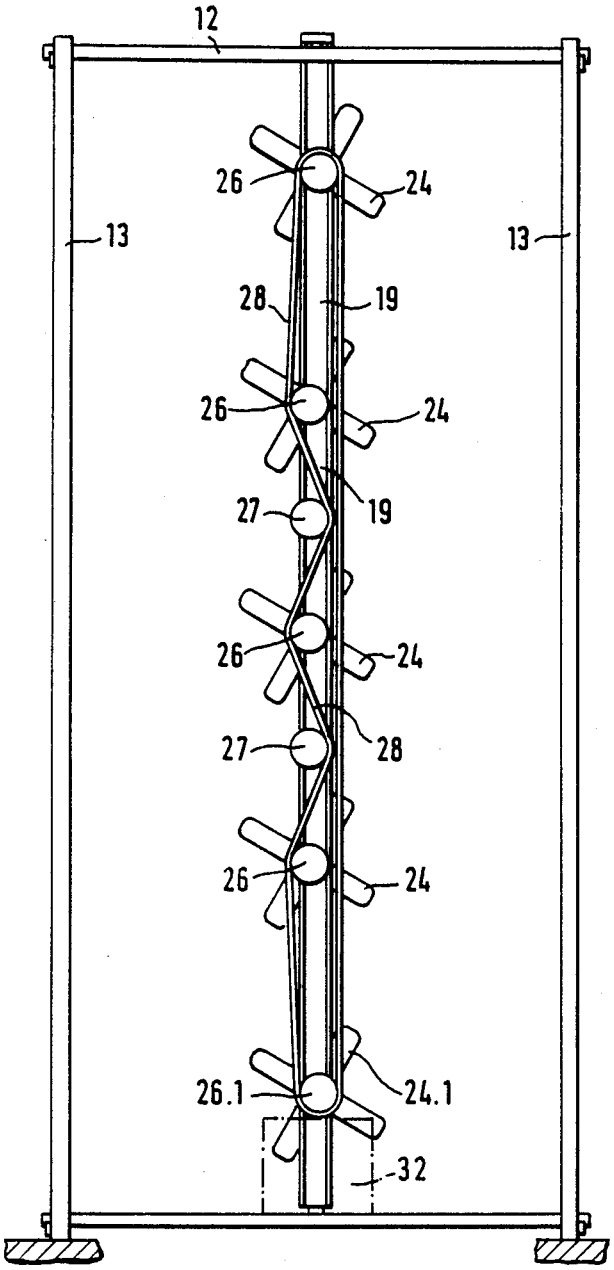
FIG. 2 is a view of the holding bar of the dust removal device of FIG. 1 seen from arrow II of FIG. 1.
Figure 3:
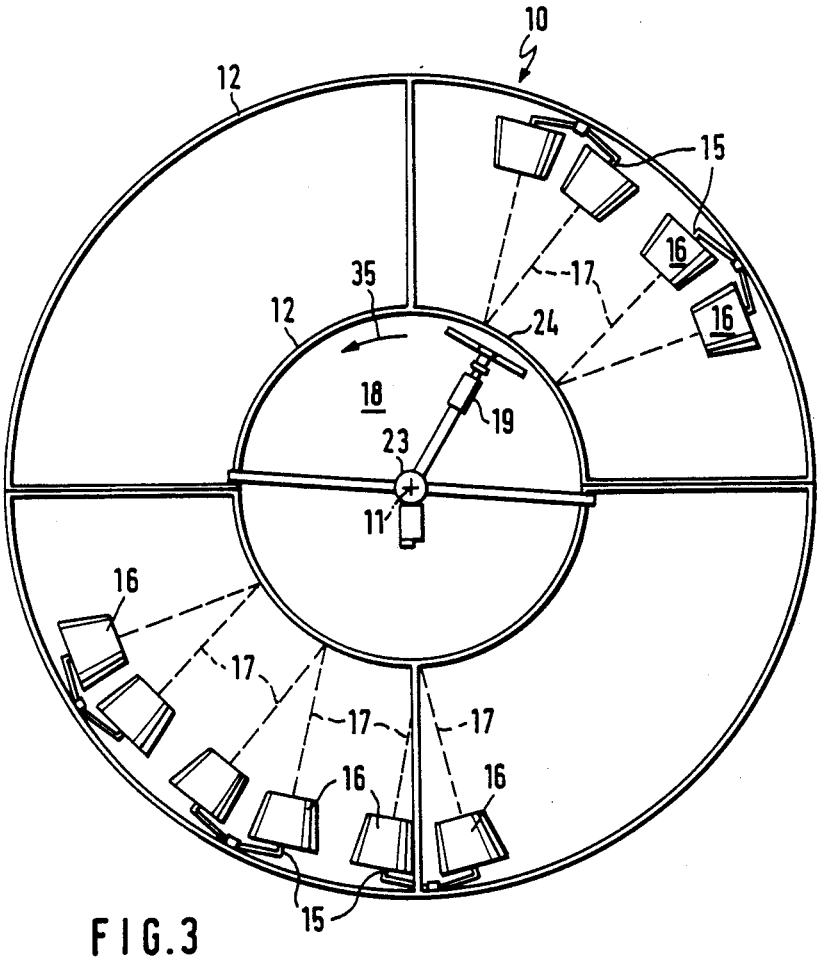
FIG. 3 is a top plan view of the circular creel yarn spool carrier seen in the direction of arrow II of FIG. 1.

Referring now to the drawings, and firstly to FIGS. 1 to 3, it will be seen that the circular creel yarn spool carrier 10 includes a circular frame 12 the central axis of which is the vertical axis 11. Frame 12 includes internal supports 13 and external supports 14 in which a plurality of plug pins 15 for yarn spools 16 are provided. Plug pins 15 extend in parallel planes which are inwardly radially sloped in the upward direction. Yarns 17 pulled over the head from the spools 16 are shown with dashed lines. The yarns in the region of internal supports 13 are guided upwardly and over the yarn spool carrier 10 to the tubular conduits positioned outside carrier 10.

In the cylindrical internal space or chamber 18 limited by frame 12 of the spool carrier 10, is positioned a dust removal device. The latter is comprised of at least one vertical holding or supporting bar 19 extending approximately over the entire height of the circular frame 12. Holding bar 19 is connected by a lower radial arm 20 and an upper radial arm 21 with concentrically positioned bearings 22 and 23. A plurality of blowers 24 spaced from each other along the height of holding bar 19 are supported on this bar. The vanes of blowers 24 are rotated about shafts 25 which extend radially and therefore normally to the central axis 11. Blowers 24 can, however, be supported on the holding bar 19 such that in addition to their rotation, they would perform a swinging motion or wobbling motion and thereby a greater blowing area than that of stationary blowers would be obtained. The vanes of blowers 24 are positioned at the side of the holding bar 19, directed outwardly towards the yarn spools, thread guiding organs and thread stretchers whereas belt pulleys 26 are each positioned at the inner side of holding bar 19 on the shafts 25 of blowers 24. All belt pulleys 26, as shown in FIG. 2, are connected to each other by means of a common belt 28 acting on the pulleys in the form-locking and/or force-locking fashion. Belt 28 is additionally guided over freely rotatably supported guide-rollers 27 each positioned between two neighboring blowers 24. As shown in FIG. 2 supporting rollers 27 ensure a sufficient contact angle between the belt 28 and each belt pulley 26. The lowermost belt pulley designed at 26.1 is the drive belt pulley and is situated on the elongated shaft 25.1 of the lowermost blower 24.1, which shaft extends parallel to the lower radial arm 20 of the holding bar 19. Shaft 25.1 is coupled by means of a gearing 29 with a vertical shaft 30 which is in alignment with the central axis 11 and is connected by means of a pinion 31 with the output shaft of a stationary drive motor 32 so as to be driven thereby.

The output shaft of the electric drive motor 32 is, in addition, coupled by a transmission 33 and gear connection 34, in the region of the lower bearing 22, with the radial arm 20 of the holding bar 19 so as to drive this radial arm and cause a circular motion of the bar 19 holding blowers 24 about the central axis 11 in the direction of arrow 35 shown in FIG. 3. The electric drive motor 32 also effects the rotation of the blowers 24 and a slow rotation of the holding bar 19 along the circular path.

In place of the single belt 28, also a plurality of endless belts can be utilized. Such endless belts would connect each respective blower 24 with the neighboring blower, and thereby a coupling of all blowers 24 with the shaft 25.1 and thus the common single drive motor 32 would be obtained. The belts can have various marketable profiles and could be made either as endless belts or belt portions connected to each other at their ends. The blowers can be also arranged differently, for example on the horizontal holding bar which would be rotationally supported at one of its ends about the vertical axis whereby the shafts of the blowers would extend parallel to the axis of rotation of the holding bar.

Figure 4:
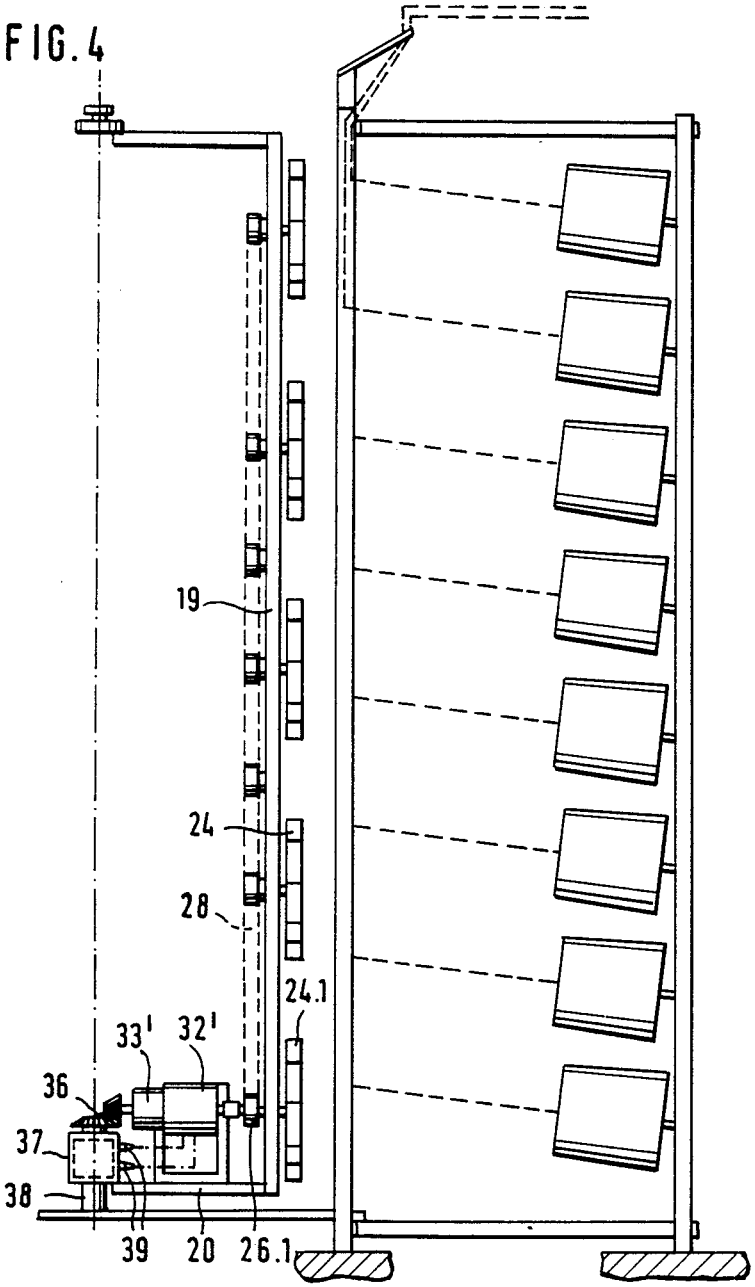
FIG. 4 is a view similar to FIG. 1 of another embodiment of the invention.
Figure 5:
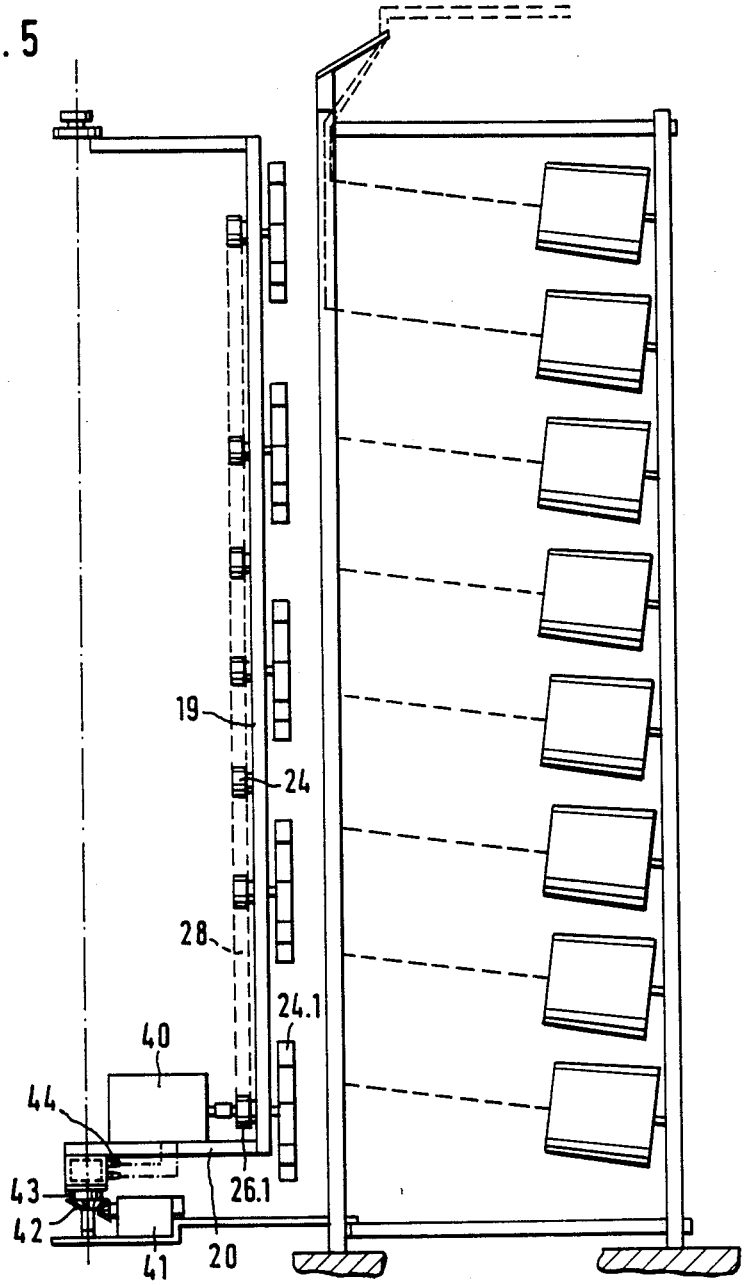
FIG. 5 is a view similar to that of FIG. 1 of a further embodiment of the invention.
Figure 6:
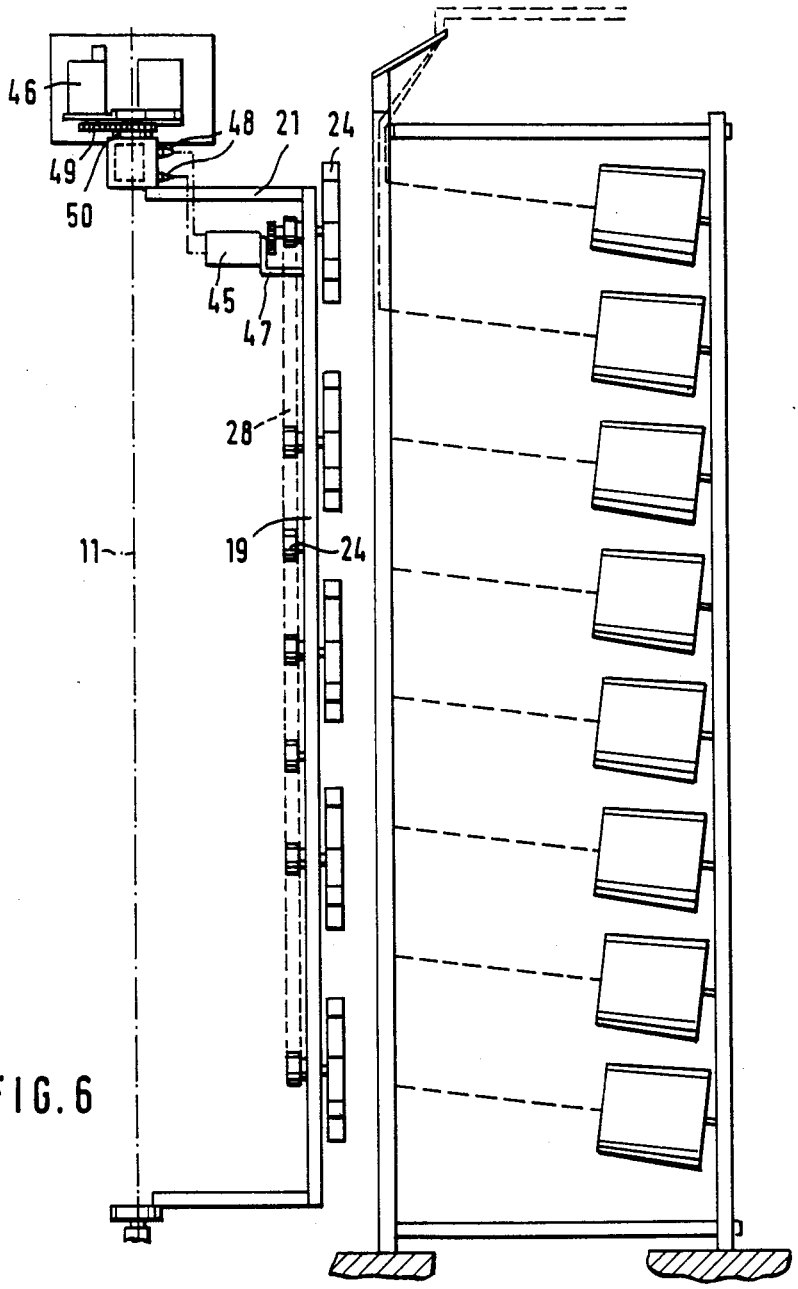
FIG. 6 is a view similar to that of FIG. 1 of still another embodiment of the invention.

FIGS. 4 to 6 illustrate the embodiments with differently-arranged or formed drive motors.

In the embodiment of FIG. 4, the drive motor 32' is secured to the radial arm 20 of the holding bar 19 and also is rotated with the holding bar 19. The lower belt pulley 26.1 is coupled directly with the output shaft of the electric motor 32' whereas the drive of the radial arm 20 is carried out via transmission or gearing 33' and a bevel gearing 36 which is supported on shaft 38 supported in a bearing box 37 and connected to the radial arm 20. Contact tracks are provided on the bearing box 37. Rotating brushes 39 transfer current from contact tracks on bearing box 37 for the electric motor 32'.

In the embodiment of FIG. 5, blowers 24 are driven by a common motor 40 which is secured to the radial arm 20 and which drives the lower belt pulley 26.1. A separate stationary motor 41 is provided for the rotation of the holding bar 19. Motor 41 actuates shaft 43 which is connected with the radial arm 20 by the bevel gearing 42. Electric current for the motor 40 rotating with the radial arm 20 is transferred by brushes 44 from the conductive strip provided on the shaft element 43 on the movable dust removal device. Motor 41 can, however, also be arranged to be parallel to the axis 11.

The embodiment of FIG. 6 is similar to that of FIG. 5 but with the drive of the dust removal device positioned at the upper end of holding bar 19. Here two motors 45 and 46 are provided, of which motor 45 is a single common motor acting on the endless belt 28 of all blowers to drive the latter and which is anchored on a bracket 47 secured to the holding bar 19. The current supply is also obtained by sliding brushes or wipers 48. Motor 46 acts via a bearing 49 on a shaft body 50 connected with the upper radial arm 21 of the holding bar 19 in any suitable (non-shown) fashion. The shaft body 50 is aligned with the axis 11. It is understandable that the single and common motor for all the blowers of the embodiments of FIG. 1 or FIG. 3 can be also positioned in the upper bearing region of the dust removal device. The single and common motor can be controlled by a control device 59 to control the speed, the running time and the running time intervals of the motor and also to obtain an intermittent motor operation.

Figure 7:
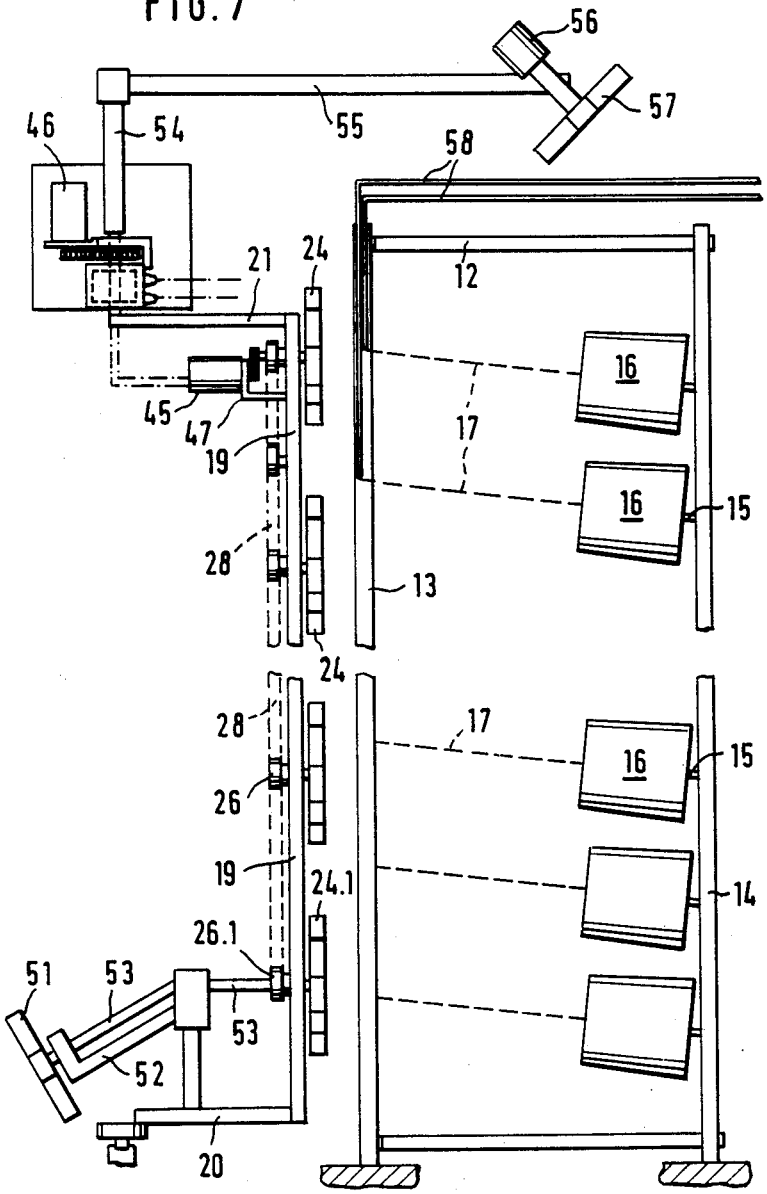
FIG. 7 is a view corresponding to that of FIG. 6, with additional blowers.

The drive according to the embodiment shown in FIG. 7 differs from that of the embodiment of FIG. 6 in that an additional blower 51, which picks up the bottom region of the circular creel spool carrier, is provided on the lower radial arm 20 of the dust removal device. Blower 51 is supported in a swinging arm or rocker 52 and is driven by the lowermost belt pulley 26.1 via the pivot shaft 53. Above the upper supporting or bearing part of the dust removal device, is positioned a radial arm 55 which is secured to an axial extention 54. At the end of the radial arm 55, is provided an additional blower 57 having its own electric motor 56. Blower 57 dusts off the upper region of the circular creel spool carrier in which region thread guiding tubes 58 extend to the non-shown textile machine. Also, a number of radial arms 55 each equipped with the additional blower whereby by an inclined position of all blowers 57, whereby a propelling action is achieved, by which the holding bar 19 can be set in rotation so that in this case the drive motor 46 can be omitted.

Also possible to provide a dust removal device in which the holding bar 19 would be provided with blow openings to which blow air would h=supplied by a common blower.

It will be understood that each of the elements described above, or two or more together, may also find a useful application in other types of dust removal devices differing from the types described above.

While the invention has been illustrated and described as embodied in a dust removal device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims. I claim:

1. A device for pneumatically removing dust from vertically spaced yarn supply carriers and thread guiding organs of textile machines, comprising a plurality of blowers movable relative to the yarn supply carriers and arranged in a vertical direction one after the other and at vertical distances from each other; means for supporting said blowers so said blowers are fixed relative to each other at said vertical distances; drive means for driving said blowers about substantially horizontal axes and including a single common motor for driving all said blowers; and a single endless element which couples said common motor with all said blowers.

2. The device as defined in claim 1, wherein said endless element is a belt.

3. The device as defined in claim 2, further including a support for additionally pivotally supporting said blowers.

4. The device as defined in claim 1, wherein said endless element is a chain.

5. The device as defined in claim 1, wherein said endless element is a tape.

6. The device as defined in claim 1, wherein said common motor additionally effects a movement of said blowers past said yarn supply carriers and thread guiding organs.

7. The device as defined in claim 1, wherein said supporting means include a common supporting bar on which said blowers are positioned.

8. The device as defined in claim 7, wherein said common motor is positioned on said supporting bar.

9. The device as defined in claim 8, for dusting off a circular creel spool carrier which includes a rotation-symmetrical frame having an inner space accommodating said blowers thereon, said supporting, bar being vertical and being movable along a circular path concentric with said frame, said drive means further including pulleys connecting said endless element to said blowers to drive the latter, said blowers being radially aligned with said circular path and being spaced from each other, each pulley being assigned to a respective blower, and guide rollers positioned between said pulleys, said endless element being guided over said pulleys and said guide rollers.

10. The device as defined in claim 9, wherein said motor is positioned below said endless element.

11. The device as defined in claim 9, wherein said motor is positioned above said endless element.

12. The device as defined in claim 9, wherein said drive means further include a shaft and a gearing connected thereto to couple said common motor with said supporting bar so as to effect the movement thereof along the circular path.

13. The device as defined in claim 12, wherein said common motor is stationarily positioned.

14. The device as defined in claim 12, wherein said motor is positioned to rotate together with said supporting bar.

15. The device as defined in claim 9, wherein said common motor is coupled to a control device to obtain an intermittent motor operation.

16. The device ass defined in claim 1, wherein a speed of said common motor, a running time and running time-intervals are controlled.

* * * * *